US010655552B2

(12) United States Patent
Kim

(10) Patent No.: US 10,655,552 B2
(45) Date of Patent: May 19, 2020

(54) CANISTER PURGE CONTROL METHOD FOR VEHICLE

(71) Applicants: Hyundai Motor Company, Seoul (KR); Kia Motors Corporation, Seoul (KR)

(72) Inventor: Seung Bum Kim, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/135,801

(22) Filed: Sep. 19, 2018

(65) Prior Publication Data

US 2019/0353112 A1 Nov. 21, 2019

(30) Foreign Application Priority Data

May 15, 2018 (KR) ..... 10-2018-0055228

(51) Int. Cl.
*F02D 41/00* (2006.01)
*F02D 41/14* (2006.01)
*F02M 25/08* (2006.01)

(52) U.S. Cl.
CPC ..... *F02D 41/0032* (2013.01); *F02D 41/0042* (2013.01); *F02D 41/0045* (2013.01); *F02D 41/1483* (2013.01); *F02M 25/089* (2013.01)

(58) Field of Classification Search
CPC ..... F02D 2200/0406; F02D 41/0032; F02D 41/004; F02D 41/0042; F02D 41/0045; F02M 25/0836; F02M 25/089
USPC ..... 123/520
See application file for complete search history.

(56) References Cited

U.S. PATENT DOCUMENTS 5,054,454 A * 10/1991 Hamburg ..... F02D 41/004 123/520
2007/0137622 A1* 6/2007 Koyama ..... F02D 41/0045 123/520
2011/0289999 A1* 12/2011 Bierl ..... F02D 41/0045 73/1.06
2013/0213366 A1* 8/2013 Weigl ..... F02D 29/02 123/520
2014/0245997 A1* 9/2014 Zhelyaskov ..... F02M 25/0836 123/519
2015/0159597 A1* 6/2015 Woods ..... F02M 25/089 123/495
2015/0285170 A1* 10/2015 Nanba ..... F02D 41/004 123/520
2015/0345411 A1* 12/2015 Ooiwa ..... F02D 41/004 123/520
2016/0123254 A1* 5/2016 Burleigh ..... F02D 41/004 123/520

(Continued)

FOREIGN PATENT DOCUMENTS

JP 2007198267 A * 8/2007
WO WO-2018198715 A1 * 11/2018

*Primary Examiner* — John M Zaleskas
(74) *Attorney, Agent, or Firm* — Mintz Levin Cohn Ferris Glovsky and Popeo, P.C.; Peter F. Corless

(57) ABSTRACT

A canister purge control method for a vehicle can reduce the number of components of an active purge system provided in the vehicle. An active purge operation is performed using a pressure value measured by an intake pressure sensor, instead of a pressure value measured by a rear-end pressure sensor, after a purge control solenoid valve is fully opened.

7 Claims, 4 Drawing Sheets

(56) References Cited

U.S. PATENT DOCUMENTS

| | | | | |
|---|---|---|---|---|
| 2016/0123280 | A1* | 5/2016 | Makino | F02M 25/089 123/519 |
| 2016/0131052 | A1* | 5/2016 | Makino | F02M 25/0836 123/520 |
| 2016/0131090 | A1* | 5/2016 | Makino | F02M 25/089 123/519 |
| 2016/0138528 | A1* | 5/2016 | Burleigh | F02M 25/0809 123/520 |
| 2016/0258389 | A1* | 9/2016 | Makino | F02M 25/0836 |
| 2016/0258390 | A1* | 9/2016 | Makino | F02M 25/0836 |
| 2017/0152802 | A1* | 6/2017 | Casetti | F02D 9/02 |
| 2017/0159588 | A1* | 6/2017 | Honjo | B01D 53/0446 |
| 2018/0163646 | A1* | 6/2018 | Tsutsumi | F02D 41/2422 |
| 2018/0216578 | A1* | 8/2018 | Wodausch | F02M 25/0827 |
| 2018/0372030 | A1* | 12/2018 | Achleitner | F02M 25/0854 |
| 2019/0101082 | A1* | 4/2019 | Sanuma | F02M 25/0836 |
| 2019/0113007 | A1* | 4/2019 | Kato | F02M 25/08 |
| 2019/0178179 | A1* | 6/2019 | Wodausch | F02D 41/0045 |
| 2019/0186423 | A1* | 6/2019 | Choi | F02M 25/0827 |
| 2019/0203666 | A1* | 7/2019 | Asanuma | F02M 25/08 |
| 2019/0211760 | A1* | 7/2019 | Choi | F02D 41/0032 |

* cited by examiner

CANISTER PURGE CONTROL METHOD FOR VEHICLE

CROSS REFERENCE TO RELATED APPLICATION

The present application claims under 35 U.S.C. § 119(a) the benefit of Korean Patent Application No. 10-2018-0055228, filed May 15, 2018, the entire contents of which are incorporated by reference herein.

BACKGROUND (a) Technical Field

The present disclosure generally relates to a canister purge control method for a vehicle, more particularly, to the canister purge control method by which the number of components of an active purge system provided in the vehicle can be reduced.

(b) Description of the Related Art

As is well known in the art, in a fuel tank of a vehicle, gas is produced by evaporation of fuel, i.e., fuel evaporation gas containing fuel components, such as hydrocarbon (HC). Thus, the vehicle is provided with a canister for collecting and storing the fuel evaporation gas so as to reduce air pollution that may result from the fuel evaporation gas in the fuel tank.

The canister is constructed by filling a container with an absorbent material able to absorb the fuel evaporation gas that has been introduced from the fuel tank. Activated carbon is widely used as the absorbent material Activated carbon acts to absorb hydrocarbon or the like, i.e., a fuel component, of the fuel evaporation gas introduced into the container of the canister.

The canister is configured such that the fuel evaporation gas is absorbed by the absorbent material when the engine is stopped, and the fuel evaporation gas is detached from the absorbent material using air pressure taken from the outside (i.e., atmosphere) when the engine is running, so that the detached fuel evaporation gas can be supplied together with the air to an intake system of the engine.

The operation of taking in the fuel evaporation gas, collecting it in the canister, and supplying the fuel evaporation gas and the air to the engine is referred to as a purge operation, and the gas taken into the engine from the canister is referral to as purge gas. The purge gas may be a mixture in which fuel components, such as hydrocarbon, detached from the absorbent material of the canister, are mixed with air.

In addition, in a purge line connecting a purge port of the canister and the intake system of the engine, a purge control solenoid valve (hereinafter referral to as "PCSV") that controls the purge operation is provided.

The PCSV opens in response to the purge operation while the engine is running. According to this configuration, the fuel evaporation gas created in the fuel tank is collected in the canister, purged to the intake system of the engine via the open PCSV, and consumed or burned in the engine.

The PCSV is controlled by a control unit, e.g. an engine control unit (ECU). The PCSV is controlled so that the PCSV is opened and closed (i.e., the purge operation is turned on and off) or the degree of opening of the PCSV is adjusted, depending on the driving status of a vehicle to control a flow of the fuel evaporation gas.

A typical configuration of the canister will be described herein. The canister includes a container filled with an absorbent material (e.g., activated carbon). In addition, a purge port, a loading port, and an air port are provided on the container. The purge port is connected to an intake system of an engine, such that fuel evaporation gas is supplied toward the engine therethrough. The loading port is connected to a fuel tank, such that fuel evaporation gas is introduced from the fuel tank therethrough. The air port is connected to an air filter (i.e., a canister filter), such that air is taken into the container from the atmosphere therethrough.

A diaphragm is disposed in the inner space of the container to divide the inner space into a space in which the air port is located and a space in which the purge port and loading port are located. The fuel evaporation gas, which is introduced through the loading port from the fuel tank, is directed to pass through the inner space divided by the diaphragm. As a result, hydrocarbon, which is a fuel component, is absorbed by the absorbent material.

In addition, when intake pressure, i.e., engine negative pressure, is applied from the intake system of the engine to the inner space of the canister through the purge port in response to the PCSV being opened by the control unit during the running of the engine, air is taken in through the air filter and the air port, and fuel evaporation gas, detached from the absorbent material, is discharged through the purge port to be taken into the engine.

In the purge operation of taking air from the atmosphere into the canister and detaching and carrying fuel components, such as hydrocarbon, from the absorbent material in the canister into the engine due to intake air, engine negative pressure is required to be applied to the canister through the purge line and the purge port.

However, the current tendency is toward reducing the number of purge operations of an engine in order to improve the fuel efficiency of vehicles. In particular, in continuously variable valve lift (CVVL) engines or hybrid electric vehicle (HEV)/plug-in hybrid electric vehicle (PHEV) engines, a reduced engine negative pressure area necessarily reduces the number of purge operations.

In addition, in vehicles provided with a turbocharger, an engine intake system, such as an intake manifold, has a relatively low negative pressure. In this case, the purge operation of the canister may be difficult.

Accordingly, an active purge system is known as a solution of the above-described problem. The active purge system is advantageous for vehicles in which the negative pressure of the intake system of the engine alone is insufficient for the purge performance and efficiency of the canister, e.g., HEV/PHEV vehicles and turbocharger vehicles, which are environmentally friendly vehicles, and turbocharger vehicles, as well as the other types of combustion engine vehicles.

In the active purge system, an active purge pump (APP) is disposed on a conduit (i.e., a purge line) connecting the purge port of the canister and the engine intake system to take in and transfer purge gas from the canister to the engine.

In the active purge system, sensors are disposed on conduits on the front and rear end sides of the pump. A control unit actively controls the operation of the pump, based on values measured by the sensors. Consequently, the purge operation of the canister can be properly performed even in conditions in which the negative pressure of the engine intake system is insufficient.

However, when the active purge system is applied, not only the pump, but also a plurality of sensors, such as pressure sensors, must be additionally provided on conduits on the front and rear end sides of the pump to control fuel evaporation gas, thereby disadvantageously increasing the cost of the vehicle.

SUMMARY

Accordingly, the present disclosure provides a canister purge control method for a vehicle, in which a number of sensors of an active purge system provided in the vehicle can be reduced as compared to conventional active purge systems.

In order to achieve the above object, according to one aspect of the present disclosure, there is provided a canister purge control method. The canister purge control method may include: opening, by a control unit, a purge control solenoid valve disposed on a purge line between a canister and an engine intake system to enable a canister purge operation during running of an engine of a vehicle; starting, by the control unit, an active purge pump of an active purge system provided in the vehicle, the active purge pump being disposed on the purge line; recognizing, by the control unit, a purge gas pressure value measured by a front-end pressure sensor disposed on the purge line, on a front end side of the active purge pump, and a pressure value measured by an intake pressure sensor disposed on an engine intake system side to which the purge line is connected; determining, by the control unit, a target purge flow rate using a difference between the purge gas pressure value measured by the front-end pressure sensor and the pressure value measured by the intake pressure sensor; and controlling, by the control unit, an operation of the active purge pump at an operating speed corresponding to the determined target purge flow rate.

According to the canister purge control method according to the present disclosure, the active purge system may be configured such that the pressure sensor on the rear end side of the active purge pump is removed from the purge line connecting the canister and the intake system of the engine. Even in the case in which the pressure sensor on the rear end side of the active purge pump is removed, the active purge operation and the control thereof can be executed using a pressure value measured by the intake pressure sensor already disposed in the vehicle.

According to another aspect of the present disclosure, a non-transitory computer readable medium containing program instructions executed by a processor includes: program instructions that open a purge control solenoid valve disposed on a purge line between a canister and an engine intake system to enable a canister purge operation during running of an engine of a vehicle; program instructions that start an active purge pump of an active purge system provided in the vehicle, the active purge pump being disposed on the purge line; program instructions that recognize a purge gas pressure value measured by a front-end pressure sensor disposed on the purge line, on a front end side of the active purge pump, and a pressure value measured by an intake pressure sensor disposed on an engine intake system side to which the purge line is connected; program instructions that determine a target purge flow rate using a difference between the purge gas pressure value measured by the front-end pressure sensor and the pressure value measured by the intake pressure sensor; and program instructions that control an operation of the active purge pump at an operating speed corresponding to the determined target purge flow rate. Accordingly, it is possible to reduce the number of sensors by removing the rear-end pressure sensor in the active purge system, thereby reducing the number of components equipped in a vehicle so as to reduce the fabrication cost of the vehicle.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION OF THE DISCLOSURE

Figure 1:
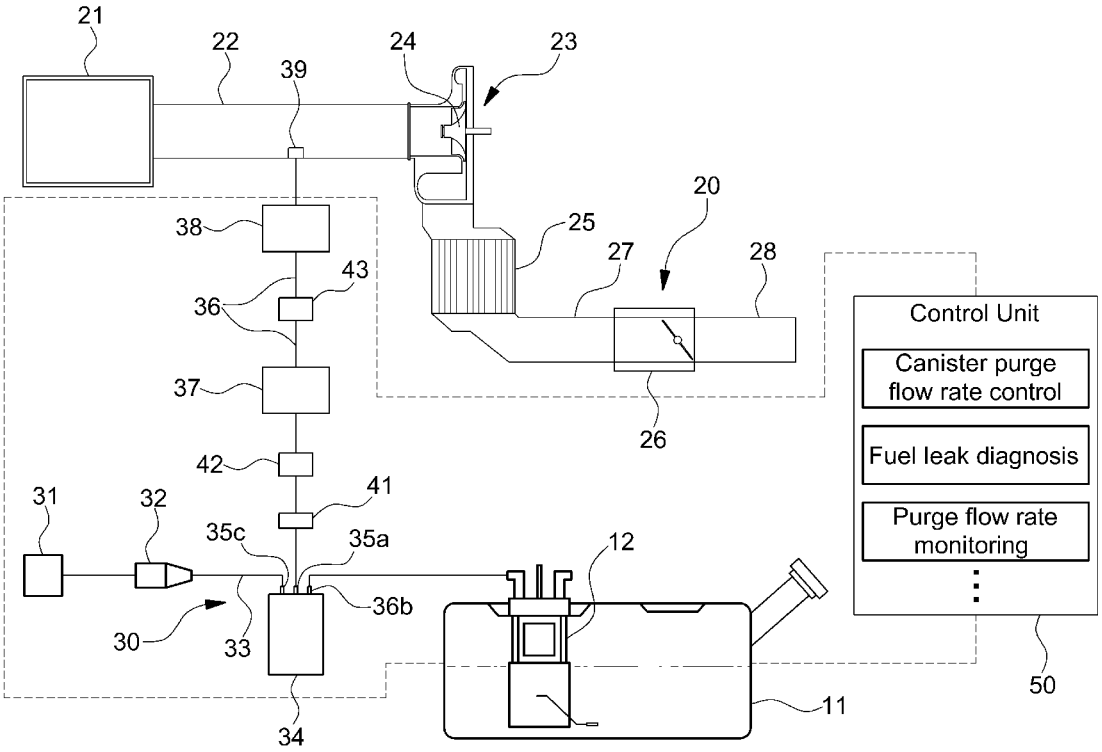
FIG. 1 (RELATED ART)
FIG. 1 (RELATED ART) illustrates a configuration of a conventional active purge system.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Exemplary embodiments of the present disclosure will be described in detail with reference to the accompanying drawings, so that those skilled in the art could easily put the present disclosure into practice. The present disclosure may be embodied in other forms without being limited to the following embodiments.

The present disclosure relates to a purge control method of an active purge system to process fuel evaporation gas created in a fuel tank of a vehicle. In particular, the present disclosure relates to a canister purge control method by which a pressure sensor on a rear end side of an active purge pump (APP) can be removed from an active purge system provided in the vehicle, thereby reducing the number of sensors in the active purge system. The reduced number of sensors can reduce the cost of components to be equipped in a vehicle, as well as the fabrication cost of the vehicle.

The canister purge control method according to the present disclosure is applicable to a vehicle provided with an active purge system.

The canister purge control method according to the present disclosure is advantageously applicable not only to typical internal combustion engine vehicles provided with an active purge system, but also to hybrid vehicles (HEV/PHEV) provided with an active purge system, in which the negative pressure area of the engine is reduced due to an electric vehicle (EV) mode in which the engine is stopped, or turbocharger vehicles provided with an active purge system, in which the negative pressure of the engine is lower than those of typical internal combustion engine vehicles.

First, an active purge system known in the art will be described with reference to the drawings for a better understanding of the present disclosure.

FIG. 1 illustrates a configuration of a known active purge system disposed in a vehicle. Referring to FIG. 1, an active purge system 30 is applied to a turbocharger vehicle, and a fuel tank 11 for storing fuel and a fuel pump module 12 for pumping fuel from the fuel tank 11 to an engine (not shown) are illustrated.

As is well known in the art, a fuel supply device of a vehicle further includes other components (not shown), in addition to the depicted components, such as the fuel tank 11 and the fuel pump module 12. The other components include a fuel filter (not shown) that removes impurities from fuel before being supplied to the engine, a fuel line (not shown) connecting the fuel tank 11 and the engine to transfer fuel, and the like.

In addition, an engine intake system 20 that takes air into the engine for combustion and a turbocharger 23 that supercharges the air to the engine using the pressure of exhaust gas discharged from the engine are provided.

The engine intake system 20 includes an engine air filter 21, a throttle body 26, an intake pipe 27, and an intake manifold 28. Further descriptions of the engine intake system will be omitted, since details thereof are well known in the art.

In addition, the turbocharger 23 that supercharges the air includes a turbine (not shown) and a compressor 24 integrally connected on a single axis. The turbine (not shown) is disposed on an engine exhaust system (not shown), through which exhaust gas is discharged from the engine, and the compressor 24 is disposed on the engine intake system 20, through which air is supplied to the engine.

When the turbine (not shown) of the turbocharger 23 is rotated by exhaust gas discharged from the engine, the compressor 24, coaxially connected to the turbine, is rotated, thereby taking in and compressing air. High-temperature and high-pressure air compressed by the compressor 24 is cooled down while passing through an intercooler 25, and then is supplied to the engine through the throttle body 26, the intake pipe 27, and the intake manifold 28.

A system for processing and controlling fuel evaporation gas created in the fuel tank 11 is provided. The fuel evaporation gas processing system includes a canister 34 that absorbs and collects fuel evaporation gas created in the fuel tank 11, a canister filter 31 that removes impurities from air taken into the canister 34, a canister vent valve 32 that opens and closes a conduit 33 between the canister filter 31 and the canister 34, and a purge control solenoid valve (hereinafter referred to as "PCSV") 38 that opens and closes a conduit (or purge line) 36 between the canister 34 and the engine intake system 20 or adjusts the degree of opening of the conduit 36.

The canister 34, the canister filter 31, and the canister vent valve 32 will be described briefly, since they are well known in the art. When the engine is stopped, an absorbent material in the canister 34 absorbs fuel evaporation gas. During running of the engine, fuel evaporation gas is detached from the absorbent material in the canister 34 using the pressure of air taken in from the outside (or atmosphere), so that the detached fuel evaporation gas is supplied together with air to the engine intake system.

In this regard, the canister 34 includes a container filled with the absorbent material (e.g., activated carbon). The container is provided with a purge port 35*a*, a loading port 35*b*, and an air port 35*c*. The purge port 35*a* is connected to the engine intake system 20, such that fuel evaporation gas is supplied toward the engine therethrough. The loading port 35*b* is connected to the fuel tank, such that fuel evaporation gas is introduced from the fuel tank therethrough. The air port 35*c* is connected to the canister filter 31 and the canister vent valve 32, such that air is taken from the atmosphere therethrough.

A diaphragm (not shown) is disposed in the inner space of the container 34 to divide the inner space into a space in which the air port 35*c* is located and a space in which the purge port 35*a* and loading port 35*b* are located. The fuel evaporation gas, introduced through the loading port 35*b* from the fuel tank, is directed to pass through the inner space divided by the diaphragm, so that hydrocarbon, a fuel component, is absorbed by the absorbent material.

The PCSV 38 is controlled by a control unit 50, e.g., an engine control unit (ECU). The PCSV 38 is controlled so that the PCSV 38 is opened and closed (i.e., the purge operation is turned on and off) or the degree of opening of the PCSV 38 is adjusted, depending on the driving status of a vehicle.

When intake pressure, i.e., engine negative pressure, is applied from the engine intake system 20 to the inner space of the canister 34 through the purge port 35*a* in response to the PCSV 38 being opened by the control unit 50 during the running of the engine, air is taken in through the canister filter 31 and the air port 35*c*, and fuel evaporation gas, detached from the absorbent material, is discharged through the purge port 35*a* to be taken into the engine.

In a typical turbocharger vehicle, the purge port 35*a* of the canister 34 is connected to a front end of the compressor 24 of the turbocharger of the engine intake system 20 through the conduit (or purge line) 36.

As illustrated in FIG. 1, the purge line 36, connected to the purge port 35*a* of the canister 34, is connected to a conduit 22 on the front end side of the compressor 24. The conduit 22 connects the engine air filter 21 and the compressor 24 of the turbocharger 23. The PCSV 38 is disposed on the purge line 36.

Specifically, the purge line 36 is connected between the PCSV 38 and the conduit 22 on the front end side of the compressor 24, allowing fuel evaporation gas containing fuel components detached from the absorbent material of the canister 34, as well as air, to be taken into the conduit 22 on the front end side of the compressor 24.

Here, the PCSV 38 may additionally be connected to the intake pipe 27 on the rear end side of the throttle body 26 and the intake manifold 28 via additional conduit (not shown).

In FIG. 1, reference numeral 39 indicates an intake pressure sensor that detects the pressure of intake air.

The active purge system 30 may be used as a fuel evaporation gas processing system in a turbocharger vehicle.

The active purge system 30 includes an active purge pump (APP) 37 disposed on the conduit (or purge line) 36 connecting the purge port 35*a* of the canister 34 and the engine intake system 20, in addition to the canister 34, the canister filter 31, and the canister vent valve 32, such that purge gas, i.e., a mixture gas of air and fuel evaporation gas detached from the absorbent material of the canister 34, is taken in by the active purge pump 37 before being transferred to the engine.

In the active purge system 30, sensors are disposed on the conduit 36 on the front end side and the rear end side of the pump, and the control unit 50 actively controls the operation of the pump, based on values measured by the sensors and vehicle driving state information collected from the vehicle.

The sensors may include pressure sensors 42 and 43 that measure a difference in pressure (or differential pressure) between the front end side and the rear end side of the pump, with respect to the active purge pump 37, and a temperature sensor 41 that measures the temperature of purge gas taken in from the canister 34 by the active purge pump 37.

In the active purge system 30, as pressure sensors, the front-end pressure sensor 42 measures the pressure of the front end side of the active purge pump 37, while the rear-end pressure sensor 43 measures the pressure of the rear end side of the active purge pump 37.

The front-end pressure sensor 42 and the temperature sensor 41 are disposed on the purge line 36 connecting the canister 34 and the engine intake system 20, in positions between the canister 34 and the active purge pump 37. The rear-end pressure sensor 43 is disposed on the purge line 36, in a position between the active purge pump 37 and the PCSV 38.

The front-end pressure sensor 42 measures the pressure of purge gas in the conduit (or purge line) on the front end side of the pump, with respect to the active purge pump 37, the temperature sensor 41 measures the temperature of purge gas in the conduit on the front end side of the pump, and rear-end pressure sensor 43 measures the pressure of purge gas in the conduit on the rear end side of the pump.

According to this configuration, the control unit 50 determines a target purge flow rate based on the values measured by the sensors and the vehicle driving status information, determines an operating speed of the active purge pump 37 based on the determined target purge flow rate, and controls the active purge pump 37 to operate at the determined operating speed.

In this manner, the control unit 50 can control the purge flow rate to be a target value (i.e., the target purge flow rate).

In addition, the control unit 50 performs basic procedures, such as fuel leak diagnosis and purge flow rate monitoring. Detailed descriptions of these procedures will be omitted, since they are known procedures performed by the control unit 50.

The active purge system and vehicle have been described as above. When the active purge system is applied, a plurality of pressure sensors must be disposed in addition to the active purge pump, thereby disadvantageously increasing the cost of the vehicle.

According to the present disclosure, it is possible to reduce the number of sensors in an active purge system of a vehicle. In particular, the rear-end pressure sensor 43, located on the rear end side of the active purge pump 37, in the conduit or purge line 36 between the canister 34 and the engine intake system 20, can be removed, according to the present disclosure, as compared to a conventional active purge system illustrated in FIG. 1.

Figure 2:
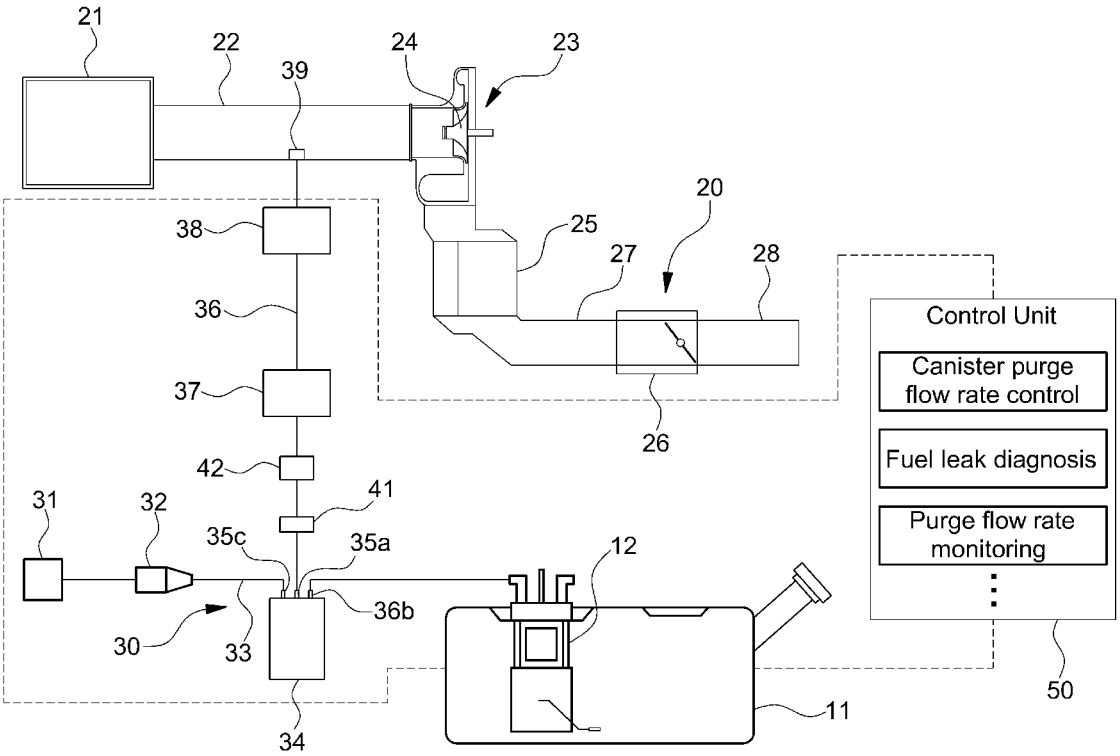
FIG. 2 illustrates a configuration of an active purge system to which a purge control method according to the present disclosure is applicable.

FIG. 2 illustrates an active purge system of the present disclosure, from which a pressure sensor is removed. It is apparent that the conventional rear-end pressure sensor (43 in FIG. 1) is removed from the rear end side of the active purge pump 37.

When the rear-end pressure sensor is removed as described above, the number of components of the active purge system can be reduced, thereby reducing the cost of components to be equipped in a vehicle, as well as the fabrication cost of the vehicle.

In the active purge system, however, the conventional control method of determining a target purge flow rate using the front-end pressure and the rear-end pressure of the active purge pump can no longer be used. Therefore, a purge control method able to process fuel evaporation gas without using the rear-end pressure sensor is required.

In this regard, the rear-end pressure sensor is removed, and the canister purge control method according to the present disclosure uses a value measured by the intake pressure sensor 39, which is already disposed in the engine intake system 20, instead of using a value measured by the rear-end pressure sensor.

The intake pressure sensor 39, serving to measure the pressure of intake air, may be disposed on the intake manifold 28 of the engine intake system 20 in typical combustion engine vehicles. In turbocharger vehicles, the intake pressure sensor 39 may be disposed on the conduit 22 connecting the engine air filter 21 and the compressor 24 of the turbocharger 23, as illustrated in FIG. 2.

The intake manifold 28 or the conduit 22 on the front end side of the compressor, on which the intake pressure sensor 39 is disposed, is a portion to which the canister purge line 36 is connected. According to the present disclosure, in the case of an active purge operation, after the PCSV 38 is fully opened, a target purge flow rate is determined using a pressure value measured by the intake pressure sensor 39.

That is, the rear-end pressure sensor is removed, and a pressure value measured by the intake pressure sensor 39 is used instead of a pressure value measured by the rear-end pressure sensor. In addition, a difference between the pressure value measured by the front-end pressure sensor 42 and the pressure value measured by the intake pressure sensor 39 is used as a difference in pressure (or differential pressure) between the front end side and the rear end side of the pump, instead of a difference between the pressure value measured by the front-end pressure sensor 42 and the pressure value measured by the rear-end pressure sensor.

In this case, however, the PCSV 38 must be controlled to remain in a fully opened position, as described above, when the difference between the pressure value measured by the front-end pressure sensor 42 and the pressure value measured by the intake pressure sensor 39 is used as the difference in pressure between the front end side and the rear end side of the pump, i.e., one piece of information about variables determining the target purge flow rate.

In summary, according to the present disclosure, the difference between the pressure value measured by the front-end pressure sensor 42 and the pressure value measured by the intake pressure sensor 39 in the fully opened position of the PCSV 38 is the difference in pressure between the front end side and the rear end side of the pump. The target purge flow rate of the active purge pump 37 is determined, based on the difference between the pressure value measured by the front-end pressure sensor 42 and the pressure value measured by the intake pressure sensor 39.

In the active purge system 30, the relationship between the target purge flow rate and the difference in pressure (of purge gas) between the front end side and the rear end side of the pump may be expressed as in Formula 1.

$$\Delta P \propto \rho X(2\pi r f)^2 \quad \text{Formula 1}$$

In Formula 1, ΔP is a pressure difference (of purge gas) between the front end side and the rear end side of the pump, i.e., the difference between the pressure of purge gas in the conduit on the front end side of the pump and the pressure of purge gas in the conduit on the rear end side of the pump.

In addition, ρ indicates a density of purge gas, r indicates the radius of the conduit (purge line) 36 through which purge gas is taken in (where the radius of the conduit on the front end side of the pump is the same as the radius of the conduit on the rear end side of the pump), and f indicates the speed of the pump.

From the energy equation, when the pump is operating at a constant speed, the pressure difference ΔP and the density ρ of purge gas have a proportional relationship as expressed in Formula 1.

In addition, with increases in the density of fuel evaporation gas of canister purge gas, fluid density increases, and the differential pressure of gas between both end sides of the pump, i.e., the difference in pressure ΔP between the front end side and the rear end side of the pump, increases proportionally. Here, the density of fuel evaporation gas may be the density of HC, i.e., a fuel component.

Thus, in the active purge system 30, there is a specific correlation between the difference in pressure between the front end side and the rear end side of the pump and the density of fuel evaporation gas. Accordingly, the use of the correlation makes it possible to determine the density of fuel evaporation gas, based on the difference in pressure between the front end side and the rear end side of the pump. Further, the target purge flow rate can be determined using the density of fuel evaporation gas.

According to the present disclosure, the rear-end pressure sensor is removed, and a pressure difference is obtained using the intake pressure sensor 39, i.e., the pressure sensor adjacent to the engine intake system 20 in which PCSV 38 is located, instead of using the rear-end pressure sensor. The target purge flow rate is determined using the obtained pressure difference as the difference in pressure between the front end side and the rear end side of the pump.

Figure 3:
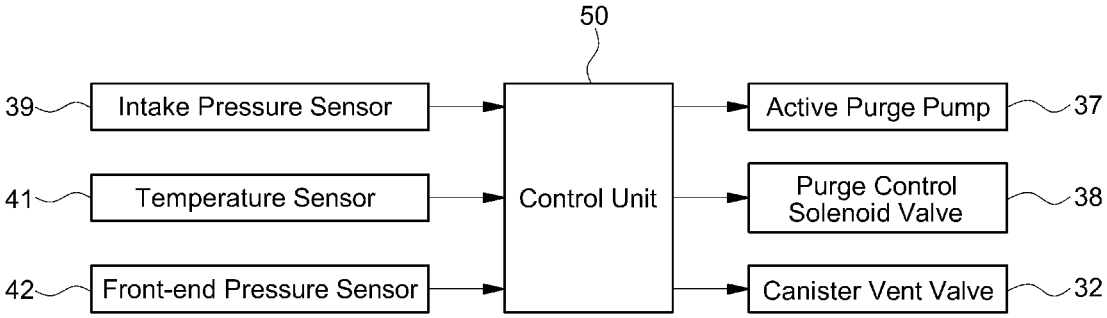
FIG. 3 is a block diagram illustrating a configuration of the active purge system executing the canister purge control method according to the present disclosure.

Hereinafter, the canister purge control method according to the present disclosure will be described in more detail. FIG. 3 is a block diagram illustrating a configuration of the active purge system executing the canister purge control method according to the present disclosure, and FIG. 4 is a flowchart illustrating the canister purge control method according to the present disclosure.

Figure 4:
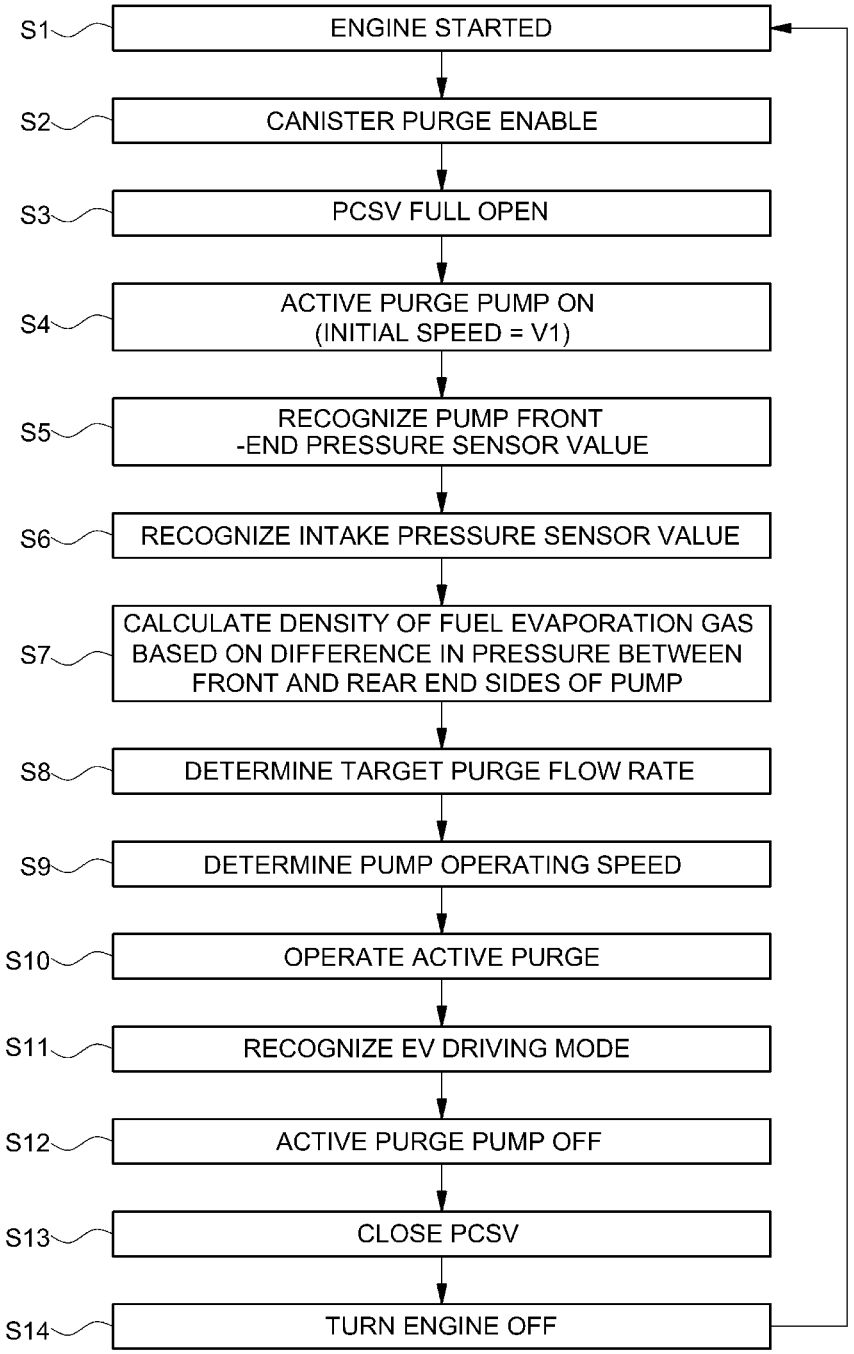
FIG. 4 is a flowchart illustrating the canister purge control method according to the present disclosure.

The control process illustrated in FIG. 4 is executed under the control of the control unit 50. First, when the engine is in running status in step S1 and the active purge system is in a canister purge enable status in step S2, the PCSV 38 is controlled to be fully opened in step S3.

The running status of the engine may mean driving in HEV mode in the case of a hybrid vehicle.

In addition, the canister purge enable status means a status in which predetermined conditions for the canister purge operation are satisfied. Detailed descriptions of such canister purge enable conditions will be omitted, since they are substantially the same as canister purge enable conditions in typical active purge system.

After the PCSV 38 is controlled to be fully opened, in step S4, the control unit 50 turns the active purge pump 37 on. Here, the operating speed of the active purge pump 37 is controlled to be a preset initial speed V1.

While the active purge pump 37 is operating at the initial speed, pressure values measured by the front-end pressure sensor 42 and the intake pressure sensor 39 are input to the control unit 50. The control unit 50 receives vehicle driving status information collected in the vehicle, in addition to the pressure values.

In steps S5 and S6, the control unit 50 checks the pressure values measured by the two pressure sensors, i.e., the pressure value measured by the front-end pressure sensor 42 and the pressure value measured by the intake pressure sensor 39. A difference between the two pressure values is calculated and is used as information about the difference in pressure between the front end side and the rear end side of the pump.

Specifically, in step S7, the control unit 50 determines the density of fuel evaporation gas in purge gas passing through the purge line 36, based on the difference between the pressure values, i.e., the information about the difference in pressure between the front end side and the rear end side of the pump. Here, the density of fuel evaporation gas, corresponding to the difference between the pressure values, is determined using previously input and stored first set data.

The active purge system and the canister purge control method according to the present disclosure are designed such that the control unit 50 determines the density of fuel evaporation gas, based on the difference between the pressure value measured by the front-end pressure sensor 42 and the pressure value measured by the intake pressure sensor 39, using the stored first set data.

The first set data is data in which the correlation between the difference in pressure and the density of fuel evaporation gas is predefined. The first set data may be obtained based on data collected via preliminary examination and evaluation processes in the vehicle development stage.

The first set data may be one selected from among a map, a table, a graph, and a formula (correlation or relation), edited based on data collected via preliminary examination and evaluation processes in the vehicle development stage. In an actual vehicle, the first set data may be previously input and stored in the control unit 50 to be used to determine the density of fuel evaporation gas corresponding to the difference in pressure, based on the difference in pressure.

Here, the density of fuel evaporation gas may be defined as the density of fuel components in purge gas, i.e., a mixture gas of fuel evaporation gas and air, more specifically, the density of hydrocarbon (HC).

When the density of fuel evaporation gas in purge gas is determined by the control unit 50, the control unit 50 determines a target purge flow rate, based on the determined density of fuel evaporation gas and the vehicle driving status information collected in the vehicle in real time, in step S8.

The target purge flow rate means a target flow rate of the pump, i.e., a target flow rate of gas transferal using the active purge pump 37.

The vehicle driving status information is information collected in real time from the vehicle, using sensors or the like. The vehicle driving status information may include an engine speed, such as revolutions per minute (RPM) of the engine.

The vehicle driving status information may further include other information in addition to the engine speed. The other information may be at least one selected from among, but not limited to, a temperature of purge gas measured by the temperature sensor 41, a vehicle speed, a degree of opening of an accelerator (i.e., an acceleration position sensor (APS) value), and an amount of fuel injected in the engine.

In the determination of the target purge flow rate from the density of fuel evaporation gas and the vehicle driving status information, the control unit 50 may use second set data, such as a map, a table, a graph, or a formula, defiling the correlation between the density of fuel evaporation gas and the vehicle driving status information.

The second set data for determining the target purge flow rate may also be previously obtained, based on data collected via preliminary examination and evaluation processes in the vehicle development stage. The second set data is input and stored in the control unit 50 before being used to determine the target purge flow rate.

When the target purge flow rate is determined by the control unit 50, the operating speed of the active purge pump 37 is determined based on the target purge flow rate in step S9. Subsequently, in step S10, the control unit 50 controls the active purge pump 37 to operate in the determined operating speed, thereby enabling an active purge operation.

Afterwards, when the vehicle is determined as traveling in EV mode in step S11, the control unit 50 turns the active purge pump 37 off in step S12, closes the PCSV 38 in step S13, and turns the engine off in step S14.

For example, when the vehicle according to the present disclosure is a hybrid vehicle (HEV/PHEV) and the control unit 50 is an engine control unit (ECU), the ECU turns the engine off in response to a control command from a hybrid control unit (HCU), acting as a higher-level control unit, in order to convert from HEV mode to EV mode. Here, the ECU closes the PCSV 38 while turning the active purge pump 37 off.

According to the above-described process, canister purge control can be performed using the intake pressure sensor 39 instead of the rear-end pressure sensor.

Figure 5:
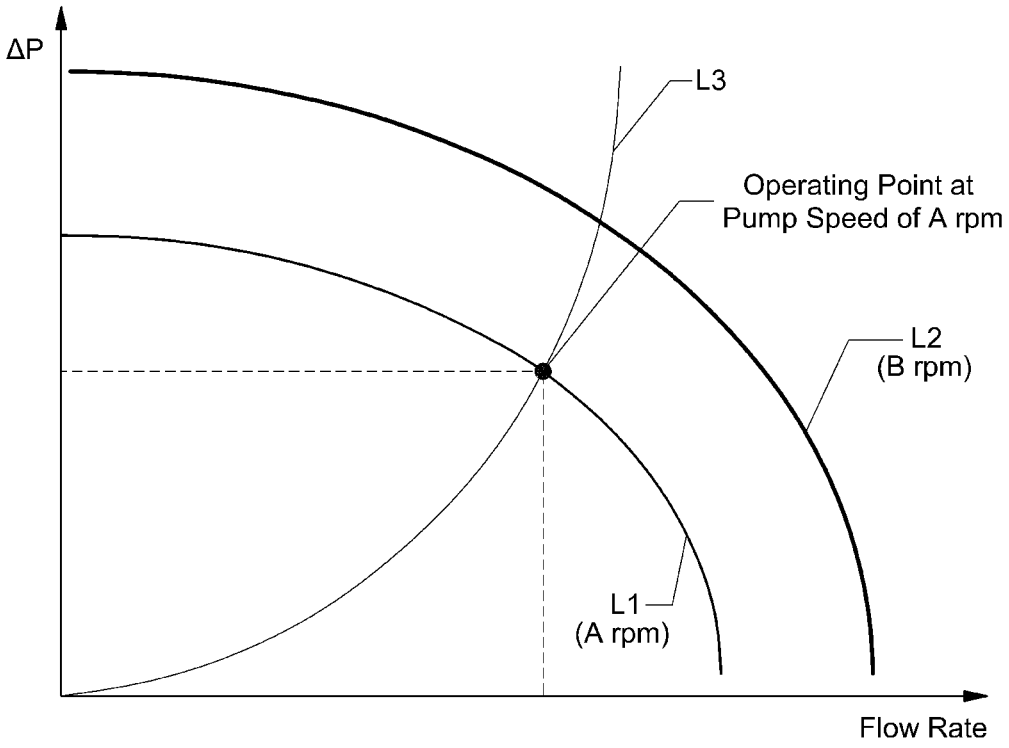
FIG. 5 is a graph illustrating points of pump operation in the purge control process according to the present disclosure.

FIG. 5 is a graph illustrating a method of determining the operating speed of the active purge pump 37 from a target purge flow rate. The operating speed, corresponding to the target purge flow rate, can be obtained using the illustrated graph.

In the graph of FIG. 5, a horizontal axis (X axis) indicates the target purge flow rate, while a vertical axis (Y axis) indicates a difference in pressure $\Delta P$ between the front end side and the rear end side of the pump.

In addition, lines L1 and L2 are pump characteristic curves. Line L1 is the pump characteristic curve at a pump speed of A rpm, while L2 is the pump characteristic curve at a pump speed of B rpm (A<B, e.g. A=30,000 rpm, B=50,000 rpm).

Although only two pump characteristic curves are illustrated in the graph of FIG. 3, these are referential examples for description but speed-specific pump characteristic curves are set according to actual operating stages of the pump.

In addition, line L3 is a system characteristic curve, which is also obtained via the preliminary examination and evaluation processes. Intersections of the system characteristic curve and the speed-specific pump characteristic curve are points of operation when the pump is operated in a speed specific manner.

In the use of the graph of FIG. 5, when the target purge flow rate is obtained by the control unit 50, a difference in pressure between the front end side and the rear end side of the pump may be obtained from the graph of FIG. 5, based on a point on the system characteristic curve corresponding to the target purge flow rate.

When the difference in pressure between the front end side and the rear end side of the pump is obtained as above, the difference in pressure between the front end side and the rear end side of the pump corresponding to the target purge flow rate is compared with differences in pressure between the front end side and the rear end side of the pump of the intersections. The operating speed of the pump may be determined to be the speed of the pump characteristic curve having a smallest (or smaller) difference.

Although an embodiment of determining the operating speed of the pump using the target purge flow rate has been described, this is provided for illustrative purposes only and the present disclosure is not limited thereto.

In addition, the process of determining the operating speed of the pump based on target purge flow rate after the determination of the target purge flow rate is a known process used to control the active purge system, and other known methods may be used.

According to the canister purge control method according to the present disclosure as set forth above, the active purge system may be configured such that the pressure sensor on the rear end side of the active purge pump is removed from the purge line connecting the canister and the intake system of the engine. Even in the case in which the pressure sensor on the rear end side of the active purge pump is removed, the active purge operation and the control thereof can be executed using a pressure value measured by the intake pressure sensor already disposed in the vehicle.

Accordingly, it is possible to reduce the number of sensors by removing the rear-end pressure sensor from the active purge system, thereby reducing the cost of components to be equipped in a vehicle and the fabrication cost of the vehicle.

Although the exemplary embodiments of the present disclosure have been described for illustrative purposes, those skilled in the art will appreciate that various modifications, additions, improvements, and substitutions are possible, without departing from the scope and spirit of the present disclosure as disclosed in the accompanying claims.

What is claimed is:

1. A canister purge control method, comprising:

opening, by a controller, a purge control solenoid valve disposed on a purge line between a canister and an engine intake system to enable a canister purge operation during running of an engine of a vehicle;

after opening the purge control solenoid valve disposed on the purge line between the canister and the engine intake system, starting, by the controller, an active purge pump of an active purge system provided in the vehicle, the active purge pump being disposed on the purge line;

after starting the active purge pump being disposed on the purge line, recognizing, by the controller, a purge gas pressure value measured by a front-end pressure sensor disposed on the purge line, on a front end side of the active purge pump, and a pressure value measured by an intake pressure sensor disposed on an engine intake system side to which the purge line is connected;

after recognizing the purge gas pressure value and the pressure value, determining, by the controller, a target purge flow rate using a difference between the purge gas pressure value measured by the front-end pressure sensor and the pressure value measured by the intake pressure sensor; and after determining the target purge flow rate, controlling, by the controller, an operation of the active purge pump at an operating speed corresponding to the determined target purge flow rate, wherein, when the target purge flow rate is obtained by the controller, a difference in pressure between the front end side and the rear end side of the active purge pump is obtained from a graph based on a point on a system characteristic curve corresponding to the target purge flow rate, and then when the difference in pressure between the front end side and the rear end side of the active purge pump is obtained, the different in pressure between the front end side and the rear end side of the active purge pump is compared with differences in pressure between the front end side and the rear end side of the active purge pump of curve intersections of speed-specific pump characteristic curves with the system characteristic curve, and then the operating speed of the active purge pump is determined to be the speed of the one of the speed-specific pump characteristic curves having a smallest difference, and wherein the system characteristic curve and the speed-specific pump characteristic curves are obtained via a preliminary examination and evaluation process.

2. The canister purge control method according to claim 1, wherein the controller opens the purge control solenoid valve by controlling the purge control solenoid valve to be fully opened.

3. The canister purge control method according to claim 1, wherein determining the target purge flow rate further comprises:

determining, by the controller, a density of fuel evaporation gas in purge gas, corresponding to the difference between the purge gas pressure value measured by the front-end pressure sensor and the pressure value measured by the intake pressure sensor, using previously input and stored first set data; and determining, by the controller, the target purge flow rate from the determined density of the fuel evaporation gas and vehicle driving status information collected in real time from the vehicle, using previously input and stored second set data.

4. The canister purge control method according to claim 3, wherein the vehicle driving status information includes an engine speed.

5. The canister purge control method according to claim 4, wherein:

the vehicle driving status information further includes at least one selected from the group consisting of: a temperature of the purge gas, a vehicle speed, a degree of opening of an accelerator, and an amount of fuel injected in the engine, and the temperature of purge gas being measured by a temperature sensor of the active purge system disposed on the purge line.

6. The canister purge control method according to claim 3, wherein:

the vehicle driving status information includes at least one selected from the group consisting of: a temperature of the purge gas, a vehicle speed, a degree of opening of an accelerator, and an amount of fuel injected in the engine, the temperature of purge gas being measured by a temperature sensor of the active purge system disposed on the purge line.

7. A non-transitory computer readable medium containing program instructions executed by a processor, the computer readable medium comprising:

program instructions that open a purge control solenoid valve disposed on a purge line between a canister and an engine intake system to enable a canister purge operation during running of an engine of a vehicle;

program instructions that start an active purge pump of an active purge system provided in the vehicle, the active purge pump being disposed on the purge line;

program instructions that recognize a purge gas pressure value measured by a front-end pressure sensor disposed on the purge line, on a front end side of the active purge pump, and a pressure value measured by an intake pressure sensor disposed on an engine intake system side to which the purge line is connected;

program instructions that determine a target purge flow rate using a difference between the purge gas pressure value measured by the front-end pressure sensor and the pressure value measured by the intake pressure sensor; and program instructions that control an operation of the active purge pump at an operating speed corresponding to the determined target purge flow rate, wherein, when the target purge flow rate is obtained by the controller, a difference in pressure between the front end side and the rear end side of the active purge pump is obtained from a graph based on a point on a system characteristic curve corresponding to the target purge flow rate, and then when the difference in pressure between the front end side and the rear end side of the active purge pump is obtained, the different in pressure between the front end side and the rear end side of the active purge pump is compared with differences in pressure between the front end side and the rear end side of the active purge pump of curve intersections of speed-specific pump characteristic curves with the system characteristic curve, and then the operating speed of the active purge pump is determined to be the speed of the one of the speed-specific pump characteristic curves having a smallest difference, and wherein the system characteristic curve and the speed-specific pump characteristic curves are obtained via a preliminary examination and evaluation process.

* * * * *